US007469505B2

(12) United States Patent
Hockman

(10) Patent No.: US 7,469,505 B2
(45) Date of Patent: Dec. 30, 2008

(54) SNOW GUARD ASSEMBLY

(76) Inventor: Mark Hockman, c/o Snow Meister, P.O. Box 586, Westtown, PA (US) 19395

( * ) Notice: Subject to any disclaimer, the term of this patent is extended or adjusted under 35 U.S.C. 154(b) by 0 days.

(21) Appl. No.: 11/605,240

(22) Filed: Nov. 29, 2006

(65) Prior Publication Data

US 2007/0095009 A1 May 3, 2007

Related U.S. Application Data

(63) Continuation of application No. 10/898,552, filed on Jul. 26, 2004, now Pat. No. 7,213,373, which is a continuation-in-part of application No. 10/784,812, filed on Feb. 24, 2004.

(51) Int. Cl.
*E04D 13/00* (2006.01)

(52) U.S. Cl. ..... 52/24; 52/25; 52/26; 248/512

(58) Field of Classification Search ..... 52/24, 52/25, 26, 741.1; 248/512, 535; 403/362, 403/388, 396
See application file for complete search history.

(56) References Cited

U.S. PATENT DOCUMENTS 5,271,194 A * 12/1993 Drew ..... 52/25
6,499,259 B1 * 12/2002 Hockman ..... 52/26
6,688,047 B1 * 2/2004 McNichol ..... 52/25
6,834,466 B2 * 12/2004 Trevorrow et al. ..... 52/24

* cited by examiner

*Primary Examiner*—Basil Katcheves
(74) *Attorney, Agent, or Firm*—William E. Jackson; Stites & Harbison PLLC

(57) ABSTRACT

A decorative snow guard assembly attachable to raised portions of a building surface such as a standing seam roof. The assembly includes a decorative snow brake plate integral with a base, means spanning between adjacent bases, and means connecting said spanning means to said bases.

2 Claims, 7 Drawing Sheets

SNOW GUARD ASSEMBLY

CROSS-REFERENCED RELATED APPLICATION

This application is a continuation of U.S. application Ser. No. 10/898,552, filed Jul. 26, 2004, now U.S. Pat. No. 7,213,373 which is a continuation-in-part of U.S. application Ser. No. 10/784,812, filed Feb. 24, 2004, both entitled "Snow Guard Assembly".

FIELD OF THE INVENTION

The present invention generally relates to a decorative snow guard assembly which is attachable to raised portions of a building surface (e.g., roof).

BACKGROUND OF THE INVENTION

With the increased use of sheet metal panels in building construction, there has been an increased need to address ways in which various building attachments can be interconnected with a metal panel surface. For example, in the case of metal roofs, there is often a need to mount/secure various types of equipments thereon. Specifically, in various climates, it may be desirable to position a snow retention device on a metal roof to control/inhibit/impede the movement of snow and/or ice down the pitch of the roof.

Sliding snow and/or ice from metal roofs can be hazardous to people, the surrounding landscape, property, and building components. For example, snow or ice sliding from a roof above an entryway may injure a passersby. Similarly, falling snow or ice can do damage to landscape features, such as shrubs, and property or building components, including automobiles or lower roofing portions. In addition, sliding snow or ice can shear off antennas, gutters or other components attached to a building roof or wall, thereby potentially causing a leak. The problem of sliding snow or ice is particularly experienced in connection with metal roofs, including raised seam roofs, (e.g., standing seam) where there is relatively little friction between the roof and the snow or ice.

Numerous snow guard devices have been developed and used in the prior art. However, there are a number of problems generally associated with one or more of the snow guard devices. For example, such devices may cause the roof to leak. Many of the prior art devices are attached to roof by a screw, nail, or other fastener which pierces the roofing surface. Such piercing of the roof can lead to undesirable leakage due to inadequate sealing or shearing of the fastener by the forces exerted thereon by sliding snow and/or ice. Alternate methods for attachment of snow guard devices to roofs such as adhesive bonding may fail to provide secure attachment and/or may be difficult to install on a sloped surface, particularly where the device is applied to a smooth non-porous roofing material such as metal.

Many known snow guard devices can also cause undesirable pinning of the roof materials. Metal roofing sheets are often designed to be movable so as to accommodate normal thermal expansions and contractions. Where snow guard devices in the prior art are attached to the roof by a screw, nail or the like, which pierces the roof surface and is anchored to an underlying structural member or deck, the design thermal movement characteristics of the roof can be compromised thereby adversely effecting the roof's performance. Based upon the foregoing, it is apparent there is a need for a mounting device for a decorative snow guard which may be positioned on a metal panel surface without adversely effecting its performance.

SUMMARY OF THE INVENTION

The present invention is generally directed toward to an improvement in the combination of a metal standing seam roof and a decorative snow guard assembly. The present invention is also generally directed to a method of mounting a decorative snow guard assembly on a roofing surface having a downward slope.

In one aspect of the present invention, the combination of a metal raised seam roof and a snow guard assembly is involved. The roof comprises a first roofing panel and a second roofing panel, each of the panels having a substantially perpendicular longitudinal edge thereon. The longitudinal edge of the first panel is positioned in close proximity to the longitudinal edge of the second roofing panel thereby forming a raised seam therealong. The snow guard assembly of the present invention comprises a decorative snow brake plate and an integral base. The base defines a groove whereby the base is locatable on the metal roof by placement of the groove about a segment of the seam. The snow guard assembly also comprises spanning means extending between adjacent snow brakes and means mounted on said snow brake base for connecting the base with said spanning means.

According to another aspect of the present invention, the decorative snow brake plate and integral base are formed out of metal and the base has integral depressions or bosses extending outwardly from the outer surfaces. The integral depressions or bosses are located near the surface of the roof whereby the spanning means is connectable to the bosses on adjacent snow brakes.

According to still another aspect of the present invention, the spanning means are fabricated from pipe wherein the hollow ends of the pipe slidably fit over the bosses or into the depressions formed on the snow brake base.

According to the method aspect of the present invention, a method of mounting a decorative snow guard assembly on a roofing surface having a downward slope in a direction from an elevated portion of said roof surface toward an edge of said roofing surface is provided. According to the method, the roofing surface has first and second displaced raised portions thereon (such as seams) with at least one base portion therebetween. The method comprises the steps of providing a first snow guard interconnected with the first raised portion of the roofing surface. The first snow guard has a base which defines a groove whereby said base is locatable about a segment of the first raised roof portion. The base also has an integral boss extending from the side of the base adjacent to the roofing surface. The method involves providing a pre-cut pipe which is dimensioned to extend between the raised portions of the roof. The method further involves inserting one end of the pipe over the boss on the snow brake base applied to one seam. The method further involves providing a second snow guard, that snow guard having a base defining a groove and an integral boss extending from the side of the base adjacent to the roofing surface. According to the method, the other end of said pipe is inserted over said boss. Thereafter, the groove formed in the snow brake base of the second snow guard is located about a segment of said second raised roof portion. The end result of the present invention is that the pipe is mounted parallel to the surface of the roof and below the height of the raised portions of the roof.

According to another aspect of the present invention, the decorative snow brake plate and integral base have a means for fastening the snow brake base to the standing seam roof portion and for connecting the base with the spanning means.

According to the method aspect of the present invention, the integral boss or depressions in the snow brake base are not necessary and, instead the method involves using a fastener means to secure the base to the raised roof portion and providing the fastener means with a portion which extends outward from the brake base to provide a protrusion to which the spanning means is attached.

These and further and objects and features of the present invention are apparent in the disclosure, which includes the above and the written specification, claims and drawings referenced below.

DESCRIPTION OF THE PREFERRED EMBODIMENTS

Figure 1:
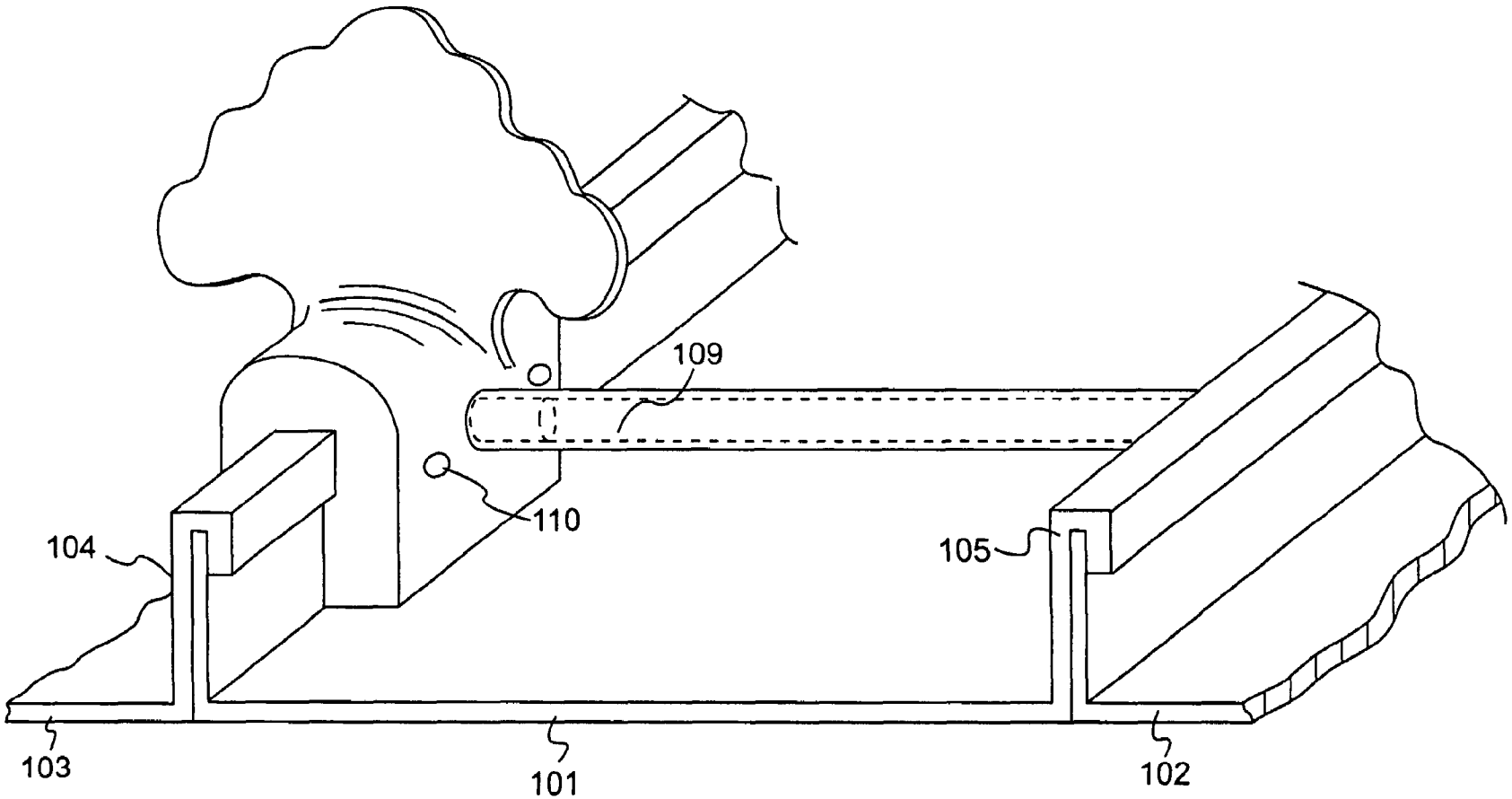
FIG. 1 is an orthogonal view of the present invention illustrating the combination of a metal standing seam roof and a snow guard assembly.

Turning to FIG. 1, an orthogonal view of the present invention used in conjunction with a snow guard assembly mounted on a metal roof is illustrated.

The metal roof comprises a plurality of metal roofing panels such as 101, 102 and 103. The longitudinal length of each panel preferably is contiguous to cover the span of the roof section. A plurality of roofing panels are laid side-by-side to cover the width of a roof section.

Each panel includes substantially perpendicular edges running along both the left and right hand sides thereof and the roofing panels are located such that their substantially perpendicular edges are abutting, thereby forming a seam therebetween.

The substantially perpendicular edges of the abutting panels are each typically crimped together and/or bent downwardly over each other to form a joint such as 104 and 105. The joint seals the adjoining panels, thereby preventing fluid communication to the roofing substructure below the roofing panels, as well as to the area between each roofing panel. Such fluid communication to the substructure could lead to the substructure becoming rotted, infested or otherwise losing or degrading its structural and integrity. The raised seam between panels can have various configurations including a rolled seam of various configurations, among other forms.

The snow guard assembly comprises a decorative snow brake plate 106 integral with a base 107. The snow brake base 107 defines a groove 108 whereby the base is locatable on the metal roof by placement of the groove about a segment of the seam. The dimensions of groove 108 may take many shapes and are not limited to those shown in the drawings illustrative of the present invention.

Figure 3:
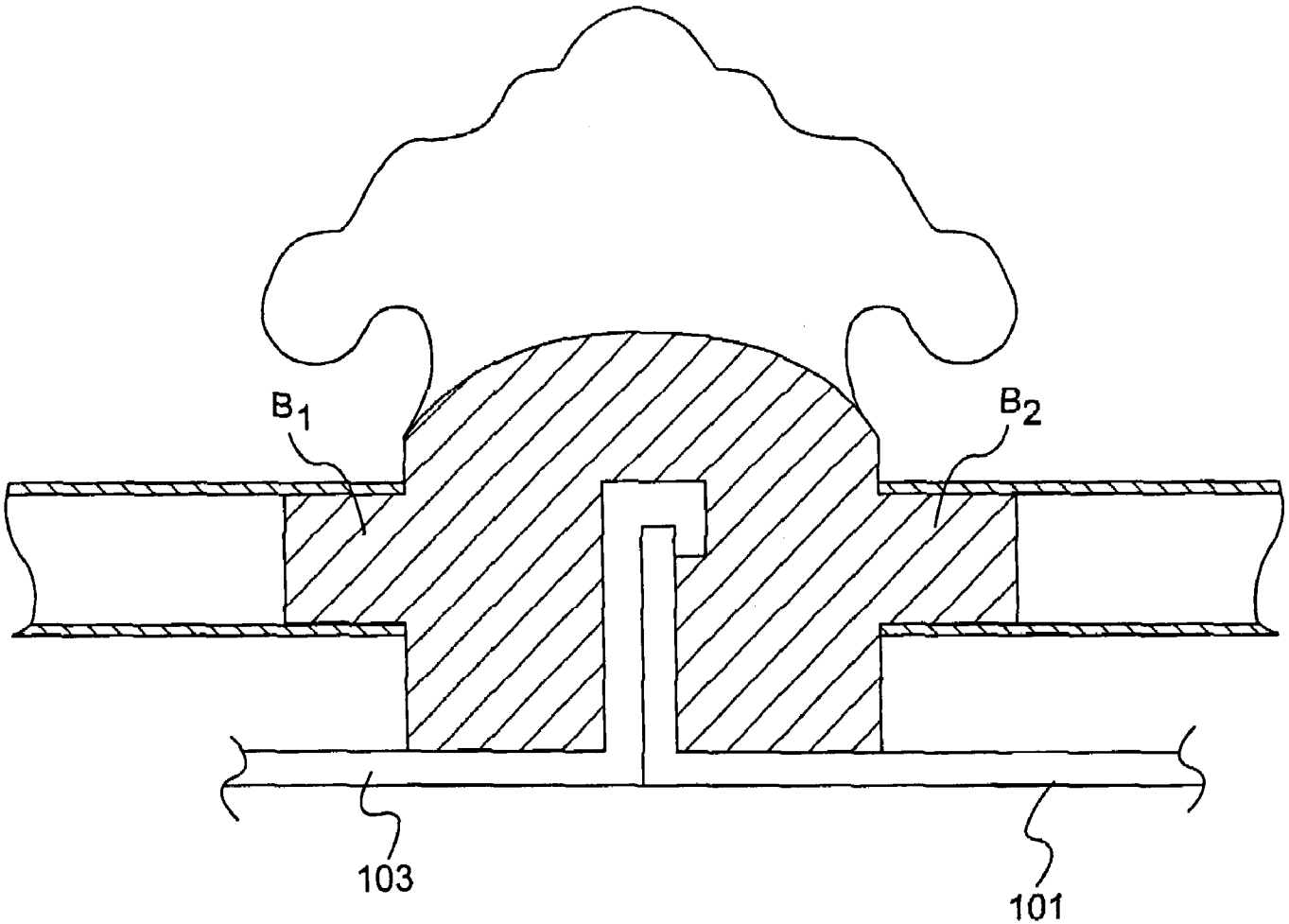
FIG. 3 is a partial cross section of the device shown in FIG. 1.

A partial cross-sectional view of FIG. 1 is illustrated in FIG. 3 which shows bosses $B_1$, $B_2$ formed at the side portions of the snow brake base 107. The bosses $B_1$ and $B_2$ are formed close enough to the bottom of the snow brake base 107 so that the interconnected pipes 109 are located between the rolled seams. Thus, the pipe 109 is located close enough to the roofing surface to block the passage of snow and ice but far enough away to allow for melting snow or rain water to pass beneath the pipe 109. It should be understood that the shape of pipes 109 may be varied within the present invention. For example, the pipe may have a rectangular cross section.

As shown in FIG. 3, the substantially perpendicular edge of roofing panel 103 is adjacent the substantially perpendicular edge of roofing panel 101, thereby forming a seam 104 therealong, with the top portions thereof folded over to prevent fluid communication to the roofing substructure below the roofing panels, as well as to the area between each roofing panel.

Figure 5:
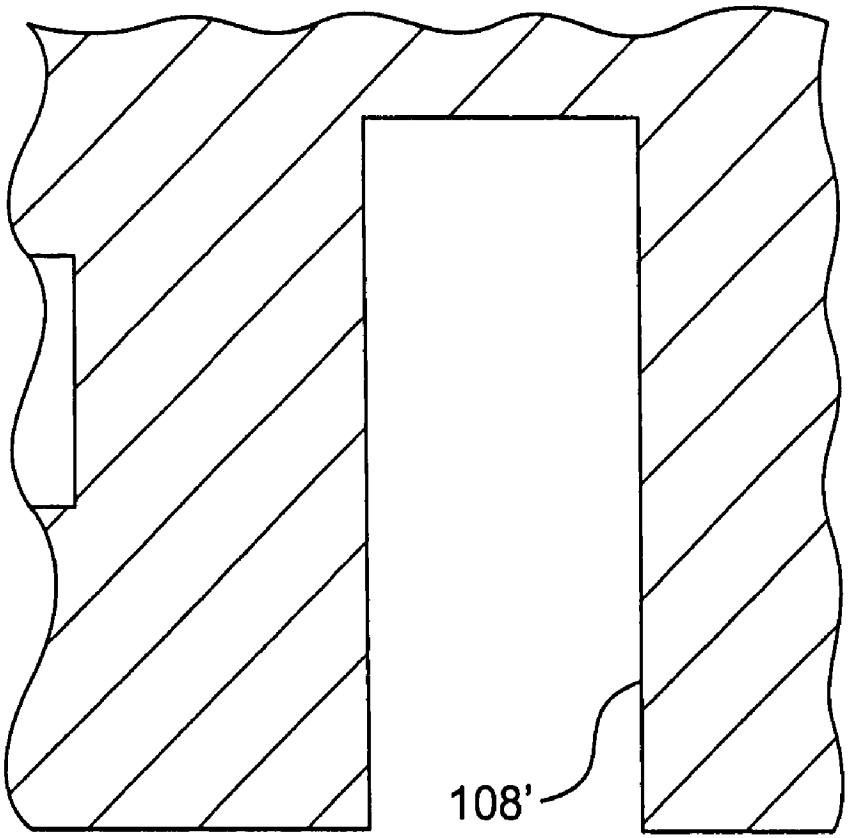
FIG. 5 is a partial cross section of the base of a snow guard with a modification of the groove for placement on a standing seam.

Set screws shown schematically at 110 are preferably driven into threaded holes and contact a portion of the seam. As shown in FIG. 3, the interior surface of the groove defined by the snow brake base is stepped so as to interlock below the lowest portion of the rolled seam 104 of the standing seam roof portion. While the specific method of attaching the snow brake base to the standing seam can take different forms, the disclosed embodiment is particularly effective. The disclosed embodiment is described in detail in Applicant's patent application Ser. No. 09/693,786, filed Oct. 20, 2000, and entitled "Non-deforming Roof Snow Brake", now U.S. Pat. No. 6,499,259. The disclosure of that patent is incorporated herein by reference. An alternate form of attachment may use the groove 108' as shown in FIG. 5.

Figure 2A:
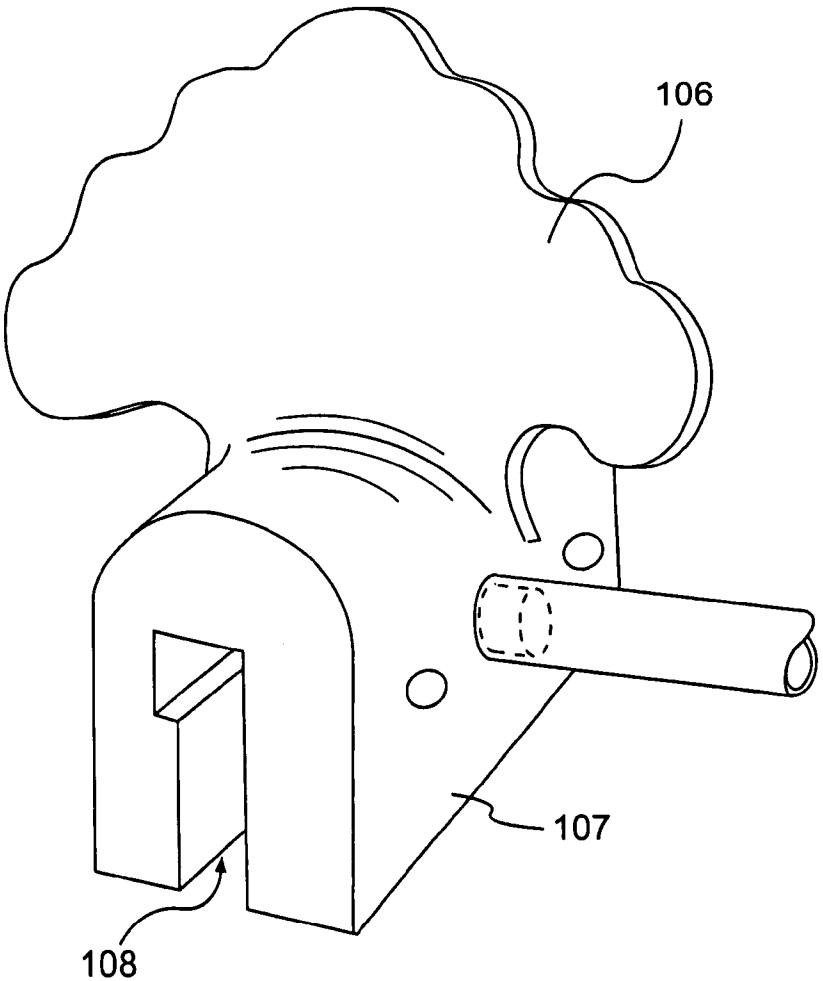
FIG. 2A is an orthogonal view of a snow guard comprising a decorative plate mounted on a snow brake base and including an integral boss according to one aspect of the present invention.
Figure 2B:
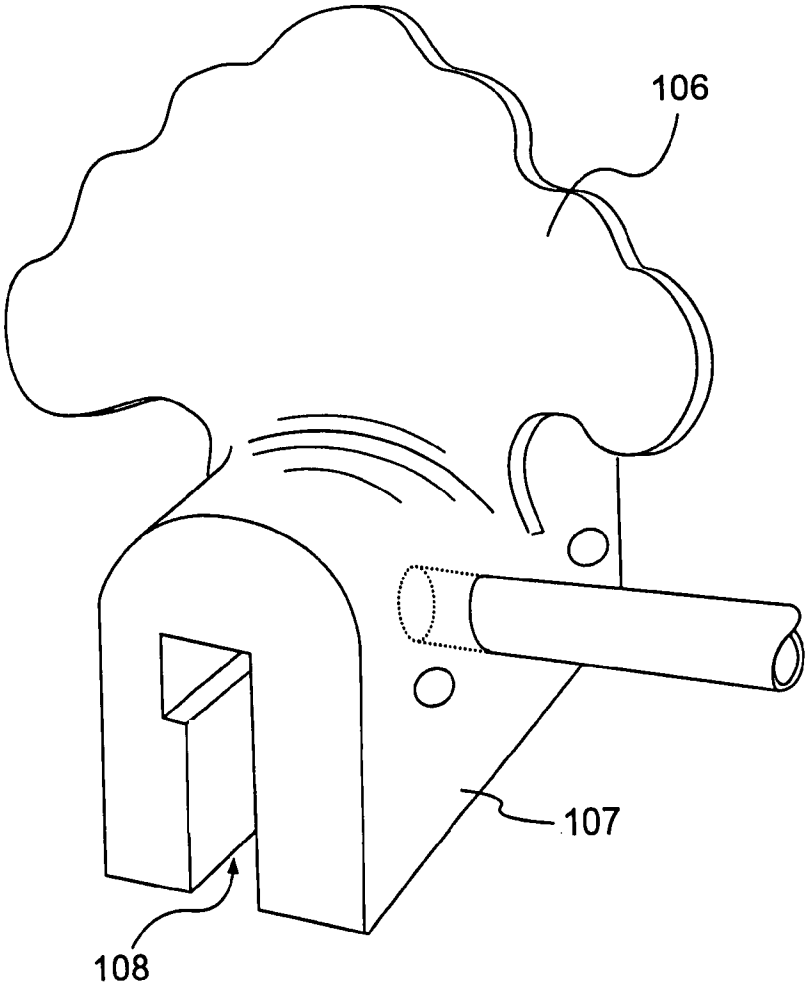
FIG. 2B is an orthogonal view of a snow guard comprising a decorative plate mounted on a snow brake base which defines a depression for the insertion of pipe members according to another aspect of the present invention.
Figure 4:
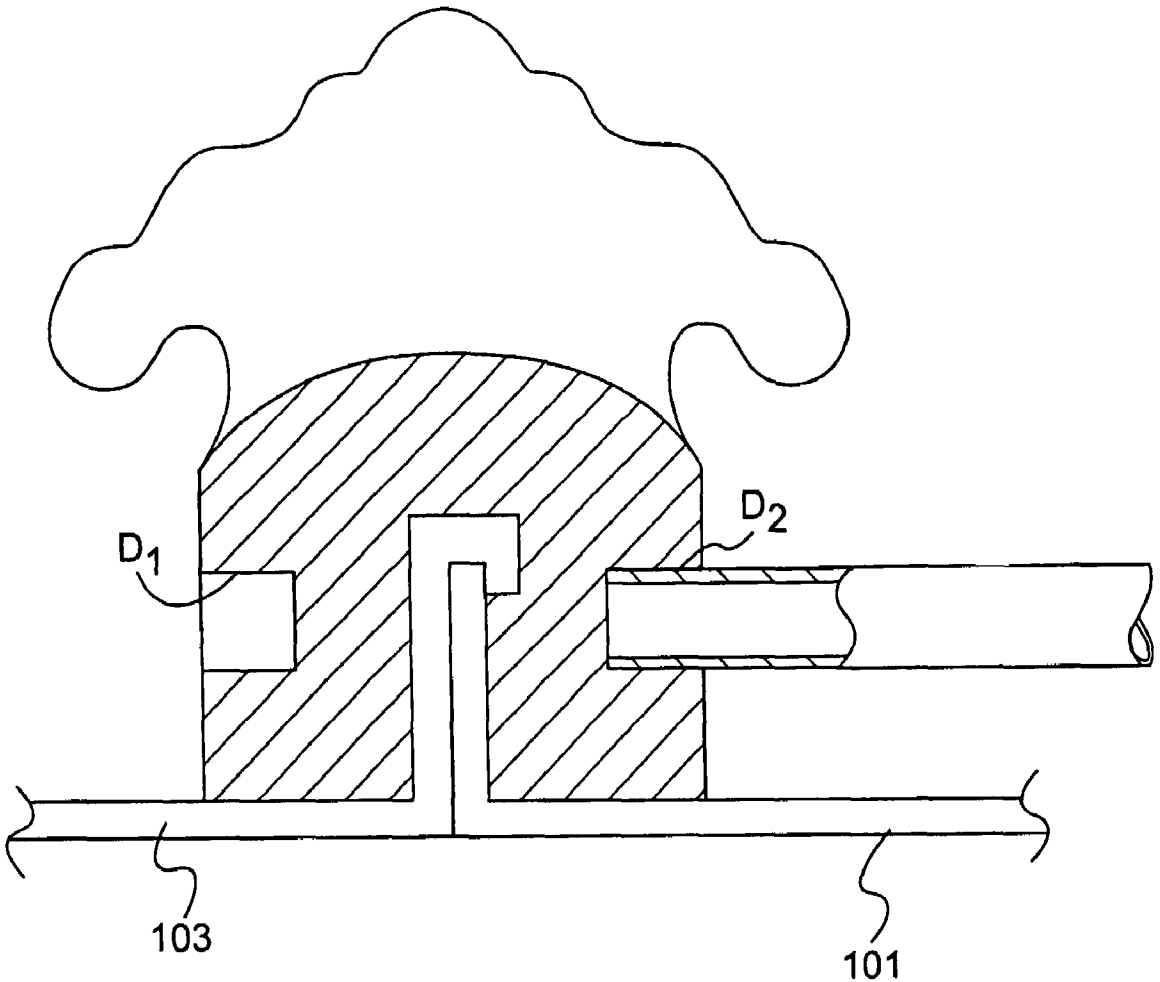
FIG. 4 is a partial cross section of the device shown in FIG. 2B.

FIG. 2B and FIG. 4 illustrate a further embodiment of the present invention wherein depressions $D_1$ and $D_2$ are defined on the sides of the snow brake base 107 and pipes 109 are dimensioned to be inserted into the depressions.

Figure 4A:
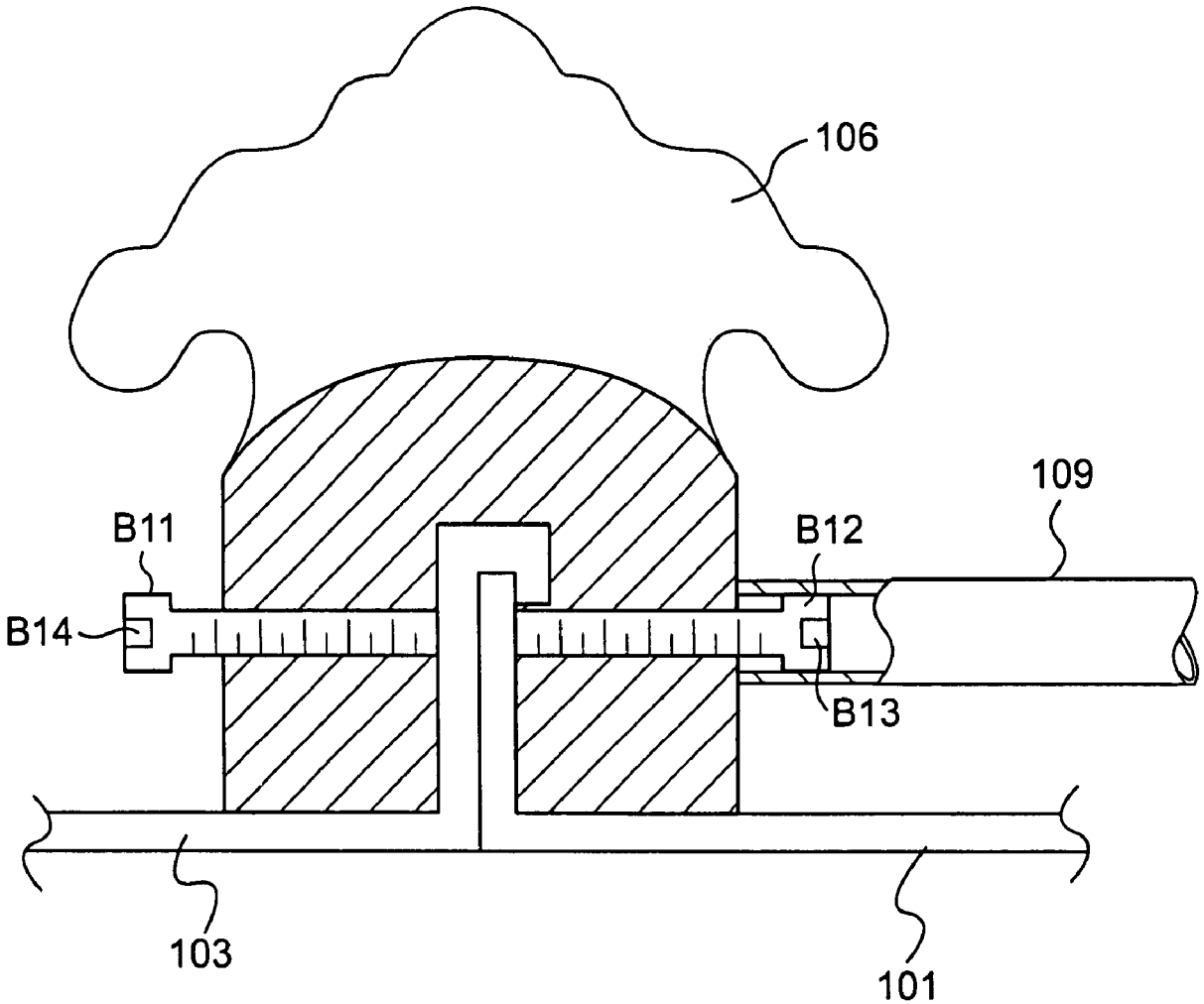
FIG. 4A is a partial cross sectional view of a device wherein fastener means secures the snow brake base to the roof seam and also connects the spanning means to the base.

FIG. 4A illustrates a further embodiment of the present invention wherein bolts $B_{11}$ and $B_{12}$ are threaded into holes in the sides of the snow brake base and the bolts protrude beyond the sides of the snow brake base. The bolts $B_{11}$and $B_{12}$ are designed with slots or the like so that they can be tightened with tools (e.g., Allen wrenches, screw drivers) toward the vertical roof seam formed between adjacent roof panels 101 and 103. In addition, the outer ends of bolts $B_{11}$ and $B_{12}$ are configured to act as means to connect the snow brake base to the end of the spanning means such as pipe 109 which has a hollow interior to fit over the head of the bolt $B_{12}$ as seen in FIG. 4A. An advantage of this embodiment is that no additional set screws are necessary as shown in FIG. 1 at 110. Also, the base of the snow brake is simplified because it does not require bosses $B_1$ and $B_2$ or depressions $D_1$ and $D_2$ as shown in FIGS. 1, 3 and 4.

It will be understood by those skilled in the art that the shape of the decorative snow brake plate 106 and its integral base 107 can take many decoratives shapes and include decorative features such as openings in plate 106 and other fan-like shapes for the plate 106 in order to match the style of the building (e.g., Victorian, Colonial). Further, the groove 108 may have various shapes and sizes depending upon the roof seam features and where it is desired to engage the seam with set screws 110 or bolts $B_{11}$ and $B_{12}$. Also, the bolts $B_{11}$ and $B_{12}$ may take various forms so long as they perform the clamping function to the roof seam and the attachment function to the spanning means exemplified by pipes 109, which also may take many forms and cross sections. It should also be understood that the form and structures of pipes 109 may be varied and can include separate telescopically-engaged pipe portions or other length-adjustment devices to facilitate assembly of the spanning pipes on adjacent snow guards.

Although illustrative embodiments of the present invention have been described in detail with reference to the accompanying drawings, it is to be understood that the invention is not limited to those precise embodiments. Various changes or modifications may be effected therein by one skilled in the art without departing from the scope or spirit of the invention.

What is claimed is:

1. A method of mounting a decorative snow guard assembly on a roofing surface having a downward slope in a direction from an elevated portion of said roofing surface toward an edge of said roofing surface, said roofing surface having first and second displaced raised portions thereon with at least one base portion therebetween, said method comprising the steps of:

providing a first snow guard interconnected with said first raised portion of said roofing surface, said first snow guard having a decorative snow brake plate with an integral base which defines a groove whereby said base is locatable about a segment of said first raised portion, said base having a bolt with one end engaging said segment and the opposite end extending from the side of the base adjacent to the roofing surface, providing a pre-cut pipe which is dimensioned to extend between said raised portions of said roof, inserting one end of said pipe over the end of said bolt extending from said base, providing a second snow guard, said snow guard having a decorative snow brake plate integral with a base defining a groove and a bolt with one end extending from the side of the base adjacent to the roofing surface, inserting the other end of said pipe over the end of said bolt extending from said base, locating the groove of said second snow guard about a segment of said second raised portion and securing said second snow guard to said second raised portion, whereby said pipe is mounted close to the base surface of said roof which extends between said raised portions.

2. A method of mounting a decorative snow guard assembly on a roofing surface having a downward slope in a direction from an elevated portion of said roofing surface toward an edge of said roofing surface, said roofing surface having first and second displaced raised portions thereon with at least one base portion therebetween, said method comprising the steps of:

providing a first snow guard interconnected with said first raised portion of said roofing surface, said first snow guard having a decorative snow brake plate integral with a base which defines a groove whereby said base is locatable about a segment of said first raised portion, said base having a connector on the side of the base adjacent to the roofing surface, providing a pre-cut pipe which is dimensioned to extend between said raised portions of said roof, connecting one end of said pipe to said connector, providing a second snow guard, said snow guard having a decorative snow brake plate integral with a base defining a groove and a connector on the side of the base adjacent to the roofing surface, connecting the other end of said pipe to said connector, said connector on said first and second snow guards being a bolt, one end of which engages said raised portion of said roofing surface and the other end being configured to connect to said pipe, locating the groove of said second snow guard about a segment of said second raised portion and securing said second snow guard to said second raised portion, whereby said pipe is mounted between said raised portions.

* * * * *